US008893778B2

(12) United States Patent
Zhou

(10) Patent No.: US 8,893,778 B2
(45) Date of Patent: Nov. 25, 2014

(54) SYSTEM AND METHOD OF FRACTURING WHILE DRILLING

(71) Applicant: Saudi Arabian Oil Company, Dhahran (SA)

(72) Inventor: Shaohua Zhou, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 55 days.

(21) Appl. No.: 13/714,485

(22) Filed: Dec. 14, 2012

(65) Prior Publication Data

US 2013/0161101 A1 Jun. 27, 2013

Related U.S. Application Data

(60) Provisional application No. 61/580,026, filed on Dec. 23, 2011.

(51) Int. Cl.
*E21B 43/26* (2006.01)
*E21B 10/60* (2006.01)
*E21B 7/00* (2006.01)

(52) U.S. Cl.
CPC ..... *E21B 7/00* (2013.01); *E21B 10/602* (2013.01); *E21B 10/60* (2013.01); *E21B 43/26* (2013.01)
USPC ..... 166/177.5; 175/230; 175/393

(58) Field of Classification Search
CPC ..... E21B 10/602; E21B 10/61; E21B 43/26
USPC ..... 175/230, 429, 393; 166/177.5
See application file for complete search history.

(56) References Cited

U.S. PATENT DOCUMENTS

| | | | | |
|---|---|---|---|---|
| 7,503,404 | B2 * | 3/2009 | McDaniel et al. | 175/57 |
| 7,516,792 | B2 | 4/2009 | Lonnes et al. | |
| 7,677,316 | B2 | 3/2010 | Butler et al. | |
| 8,065,935 | B2 | 11/2011 | Sherwood et al. | |
| 2005/0011678 | A1 | 1/2005 | Akinlade et al. | |
| 2005/0230107 | A1 | 10/2005 | McDaniel et al. | |
| 2007/0284106 | A1 | 12/2007 | Kalman et al. | |
| 2009/0065198 | A1 | 3/2009 | Suarez-Rivera et al. | |

(Continued)

OTHER PUBLICATIONS

PCT International Search Report and the Written Opinion of the International Searching Authority dated Feb. 10, 2014; International Application No. PCT/US2012/070481; International File Date: Dec. 19, 2012.

*Primary Examiner* — Giovanna Wright
(74) *Attorney, Agent, or Firm* — Bracewell & Giuliani LLP; Constance Gall Rhebergen; Keith R. Derrington

(57) ABSTRACT

A system for a drilling and fracturing a wellbore in a single trip includes a drill string, drill bit, and a fluid flow means for delivering fluid through the string and drill bit. The drill bit includes a body with cutting elements, and nozzles between the cutting elements for washing away drilling generated cuttings. A packer on the drill bit selectively seals with an inner surface of the wellbore. Deploying the packer at a designated spot in the wellbore defines a fracturing zone in the wellbore. Closing the nozzles while opening side ports on the body delivers fracturing fluid into the space. A pressurizing system can be included to pressurized the fluid so that pressure in the space overcomes the formation strength and fractures the formation adjacent the enclosed space. The packer can be released, drilling can resume, and fracturing can occur at a different depth in the wellbore.

18 Claims, 3 Drawing Sheets

(56) References Cited

U.S. PATENT DOCUMENTS

2009/0095474 A1 4/2009 Lesso et al.
2009/0145660 A1 6/2009 Johnson et al.
2009/0151938 A1 6/2009 Conkle et al.
2010/0147594 A1 6/2010 Lamin et al.
2010/0155147 A1 6/2010 Oxford et al.
2010/0243242 A1 9/2010 Boney et al.

* cited by examiner

SYSTEM AND METHOD OF FRACTURING WHILE DRILLING

CROSS REFERENCE TO RELATED APPLICATIONS

This application claims priority to and the benefit of co-pending U.S. Provisional Application Ser. No. 61/580,026, filed Dec. 23, 2011, the full disclosure of which is hereby incorporated by reference herein for all purposes.

BACKGROUND OF THE INVENTION

1. Field of the Invention

The present invention relates to a system and method for use in producing fluid from a wellbore. More specifically, the invention relates to a system and method for fracturing a subterranean formation while at the same time drilling a wellbore in the formation.

2. Description of the Related Art

Hydrocarbon producing wellbores extend subsurface and intersect subterranean formations where hydrocarbons are trapped. The wellbores generally are created by drill bits that are on the end of a drill string, where typically a drive system above the opening to the wellbore rotates the drill string and bit. Cutting elements are usually provided on the drill bit that scrape the bottom of the wellbore as the bit is rotated and excavate material thereby deepening the wellbore. Drilling fluid is typically pumped down the drill string and directed from the drill bit into the wellbore. The drilling fluid flows back up the wellbore in an annulus between the drill string and walls of the wellbore. Cuttings produced while excavating are carried up the wellbore with the circulating drilling fluid.

Sometimes fractures are created in the wall of the wellbore that extend into the formation adjacent the wellbore. Fracturing is typically performed by injecting high pressure fluid into the wellbore and sealing off a portion of the wellbore. Fracturing generally initiates when the pressure in the wellbore exceeds the rock strength in the formation. The fractures are usually supported by injection of a proppant, such as sand or resin coated particles. The proppant is generally also employed for blocking the production of sand or other particulate matter from the formation into the wellbore.

SUMMARY OF THE INVENTION

Described herein is a system for use in a subterranean wellbore. In an example, the system includes a drill bit on an end of a drill string, where the drill bit is in selective fluid communication with pressurized fluid. Also included is a packer on the drill string that selectively seals against an inner surface of the wellbore. The sealing packer defines an enclosed space in a lower portion of the wellbore. A fracturing port on the drill bit selectively opens and closes, and is in communication with the source of the pressurized fluid. In an alternative, the system can further include a drilling fluid exit nozzle on the drill bit that is selectively opened and closed. In this example, the source of the pressurized fluid is a first source of pressurized fluid, and the drilling fluid exit nozzle is in communication with a second source of pressurized fluid. Further, the pressurized fluid from the second source of pressurized fluid is drilling fluid. In one example, when the drill string is being rotated for drilling a wellbore, the exit nozzle is open so that fluid flows from the exit nozzle into the wellbore, and when the fracturing port is open and the packer is deployed, pressurized fluid from the second source of pressurized fluid flows from the drill bit into the space to create a fracture in a portion of a formation circumscribing the wellbore. The system can further include a pressure intensifier having an inlet in communication with the source of pressurized fluid and an exit in communication with the bit, so that when the pressure intensifier is operating and receives fluid from the source of pressurized fluid, a pressure of the fluid is increased by the pressure intensifier. The packer can be mounted on a collar that is attached to a portion of the bit adjacent the drill string. In one alternative, the system can further include elongated cutter blades on an outer surface of the bit and a channel defined between the blades, and wherein the drilling fluid exit nozzle is disposed in the channel In one example, the source of pressurized fluid is disposed outside of the wellbore.

Also disclosed herein is a system for use in operations in a subterranean wellbore, where the system can include a drill bit depending from a string of tubulars which defines a drill string. Included with this example is a seal that selectively expands radially outward from the drill string into sealing engagement with an inner surface of the wellbore and a drilling nozzle on the bit in selective communication with a source of pressurized drilling fluid, and a fracturing port on the drill bit in selective communication with a source of pressurized fracturing fluid. The seal can be a packer that mounts onto the drill bit adjacent the string of tubulars. In one example, the fracturing port is disposed between the seal and the drilling nozzle. In an example embodiment, when the fracturing port is open, the drilling nozzle is closed, and when the fracturing port is closed the drilling nozzle is open. The system can optionally further include an intensifier in the drill string for receiving fluid from the source of pressurized fluid, further pressurizing the fluid, and directing the further pressurized fluid to the drill bit.

The present disclosure also include a system for forming and fracturing a subterranean wellbore that is made up of a drill bit depending from a length of drill pipe to define a drill string, a seal that selectively expands radially outward from the drill string into sealing engagement with an inner surface of the wellbore, a drilling nozzle on the bit in selective communication with a source of pressurized drilling fluid that is in an open position when the drill bit is drilling the wellbore, and a fracturing port on the drill bit in selective communication with a source of pressurized fracturing fluid that is in a closed position when the drill bit is drilling the wellbore and is selectively opened when the drill bit is rotationally stationary, so that the pressurized fracturing fluid can flow from the inside the drill bit and into the wellbore and fracture the wellbore. In this example, the seal is on the drill bit to define a discrete sealed space in the wellbore adjacent the drill bit, that when subjected to the pressurized fracturing fluid can be fractured at a location within a discrete zone in the formation.

BRIEF DESCRIPTION OF THE DRAWINGS

So that the manner in which the above-recited features, aspects and advantages of the invention, as well as others that will become apparent, are attained and can be understood in detail, a more particular description of the invention briefly summarized above may be had by reference to the embodiments thereof that are illustrated in the drawings that form a part of this specification. It is to be noted, however, that the appended drawings illustrate only preferred embodiments of the invention and are, therefore, not to be considered limiting of the invention's scope, for the invention may admit to other equally effective embodiments.

DETAILED DESCRIPTION OF THE EXEMPLARY EMBODIMENTS

Figure 1:
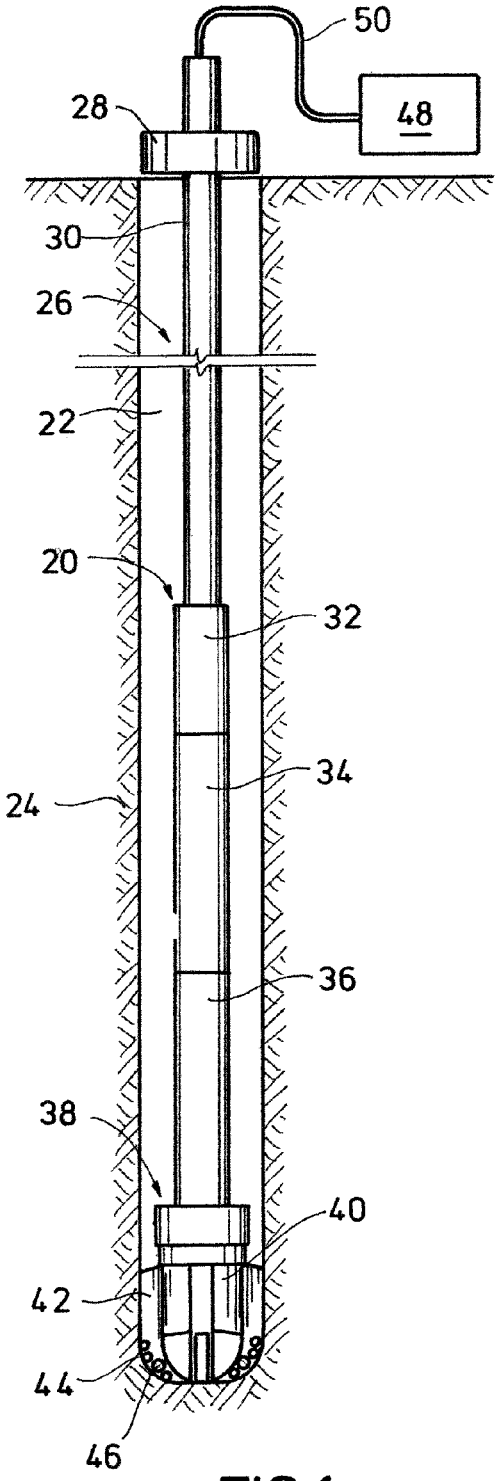
FIG. 1 is a side partial sectional view of an example embodiment of a drilling and fracturing system forming a wellbore in accordance with the present invention.

An example embodiment of a drilling system 20 is provided in a side partial sectional view in FIG. 1. In the example of FIG. 1, the drilling system 20 is shown forming a wellbore 22 through a formation 24. The drilling system 20 illustrated is made up of an elongated drill string 26 that receives a rotational force from a drive system 28 shown schematically represented on the surface and above an opening of the wellbore 22. Examples exist where the drive system 28 is a top drive or a rotary table. A number of segments of drill pipe 30 threadingly attached together form an upper portion of the drill string 26. An optional swivel master 32 is schematically illustrated on a lower end of the drill pipe 30; the lower end of the swivel master 32 is shown connected to an upper end of a directional drilling assembly 34. As is known, implementation of the swivel master 32 allows the portion of the drill string 26 above the swivel master 32 to be rotated without any rotation or torque being applied to the string 26 below the swivel master 32. The directional drilling assembly 34 may include gyros or other directional type devices for steering the lower end of the drill string 26. Also optionally provided is an intensifier 36 coupled on a lower end of the directional drilling assembly 34. In one example, the pressure intensifier 36 receives pressurized fluid and discharges the fluid at a greater pressure.

Figure 2:
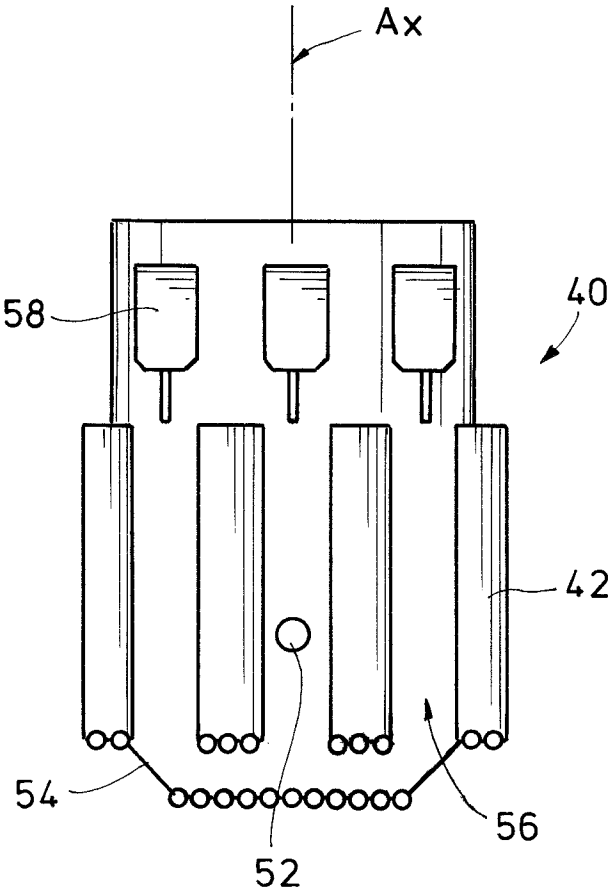
FIG. 2 is a side view of an example of a drill bit for use with the system of FIG. 1 in accordance with the present invention.

A drill bit assembly 38 is shown mounted on a lower end of the intensifier 36. The bit assembly 38 includes a drill bit 40, shown as a drag or fixed bit, but may also include extended gauge rotary cone type bits. Cutting blades 42 extend axially along an outer surface of the drill bit 40 and are shown having cutters 44. The cutters 44 may be cylindrically shaped members, and may also optionally be formed from a polycrystalline diamond material. Further provided on the drill bit 40 of FIG. 1 are nozzles 46 that are dispersed between the cutters 44 for discharging drilling fluid from the drill bit 40 during drilling operations. As is known, the fluid exiting the nozzles 46 provides both cooling of cutters 44 due to the heat generated with rock cutting action and hydraulically flushes cuttings away as soon as they are created. The drilling fluid also recirculates up the wellbore 22 and carries with it rock formation cuttings that are formed while excavating the wellbore 22. The drilling fluid may be provided from a storage tank 48 shown on the surface that leads the fluid into the drill string 26 via a line 50. Pumps (not shown) may be included in the drilling system 20 for pressurizing FIG. 2 is a side view example of the drill bit 40 that further includes a fracturing nozzle 52 shown formed through a body 54 of the drill bit 40. The nozzles 46 (FIG. 1) and fracturing nozzle 52 are both selectively in fluid communication with fluid provided from the tank 48, and may each be opened or closed at designated times. In one example embodiment, the nozzles 46 are open and fluid flowing from the tank 48 in line 50 through the drill string 26 exits the nozzles 46 from the drill bit body 54; in this example the frac nozzle 52 is in a closed position so that no fluid flows from the fracturing nozzle 52 through the bit body 54. Conversely, another example exists wherein the fracturing nozzle 52 is open; in this example fluid flowing from the tank 48 in line 50 through the drill string 26 exits the fracturing nozzle 52 at a same time that the nozzles 46 are in a closed position and without fluid exiting through the nozzles 46.

Further illustrated in FIG. 2 are spaces between adjacent cutting blades 42 that define channels 56 that extend along an outer surface of the bit body 54. Further in the example of FIG. 2, the cutting blades 42 and channels 56 run substantially parallel within axis $A_x$ of the drill bit 40. On the body 54 and above upper ends of the cutting blades 42 are sliding blades 58, that as will be described in more detail below are axially movable from their location as shown in FIG. 2 and into the channels 56. In one example, as the sliding blades 58 slide into the channels 56, their respective lateral sides sealingly engage opposing lateral sides of the cutting blades 42.

Figure 3:
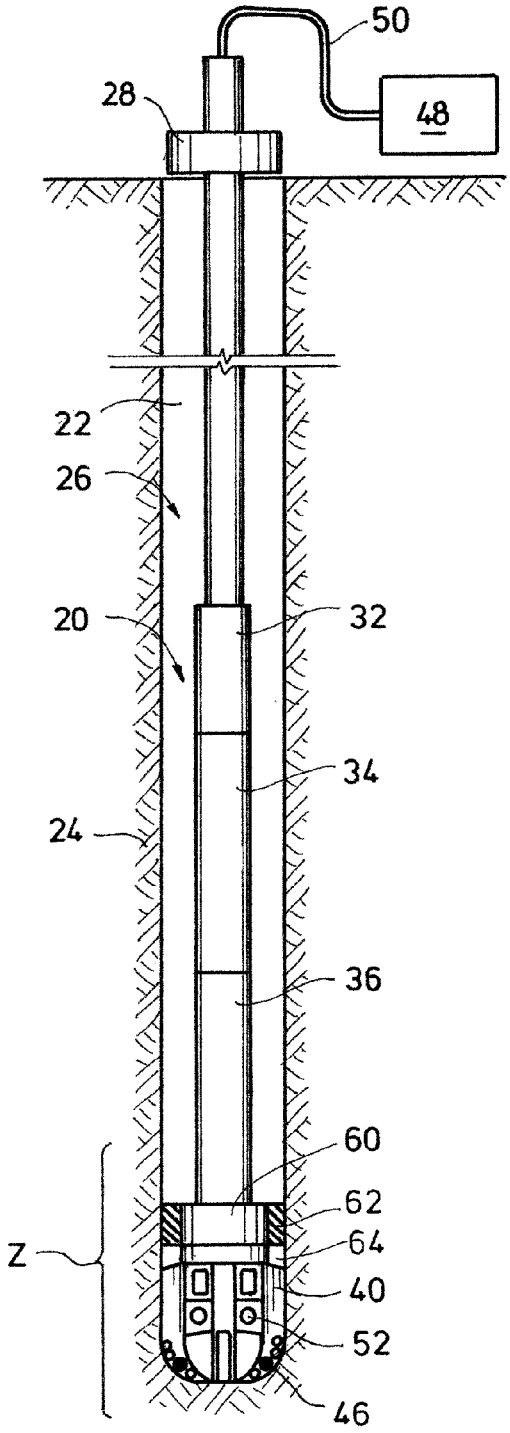
FIG. 3 is a side partial sectional view of an example of the system of FIG. 1 initiating a fracturing sequence in accordance with the present invention.

Referring now to FIG. 3, illustrated is an example of the drilling system 20 initiating a sequence for fracturing the, formation 24. In the example of FIG. 3, the bit 40 is shown at a depth in the wellbore 22 adjacent a designated zone Z where fracturing is to be attempted. In this example of fracturing, the nozzles 46 are closed thereby restricting fluid from exiting the bit 40 through the nozzles 46. In contrast and as discussed above, the fracturing nozzles 52 are shown set into an open position so that fluid may be discharged from the bit 40 through the fracturing nozzles 52. A collar 60 is further illustrated on the drill string 26 and proximate an upper end of the bit 40. On an outer circumference of the collar 60 is a packer 62 that is shown being inflated and expanding radially outward from the collar 60 and into sealing engagement within inner surface of the wellbore 22. The packer 62 when inflated and sealing against the wellbore 22 defines a space 64 between the bit 40 and wellbore 22 that is sealed from portions of the wellbore 22 that are above the collar 60. In an example, after forming the sealed space 64 fluid is discharged from the fracturing nozzles 52 into the space 64. The fluid pressure in the space 64 exerts a stress on the formation 24 that exceeds a tensile stress in the rock formation 24.

Figure 4:
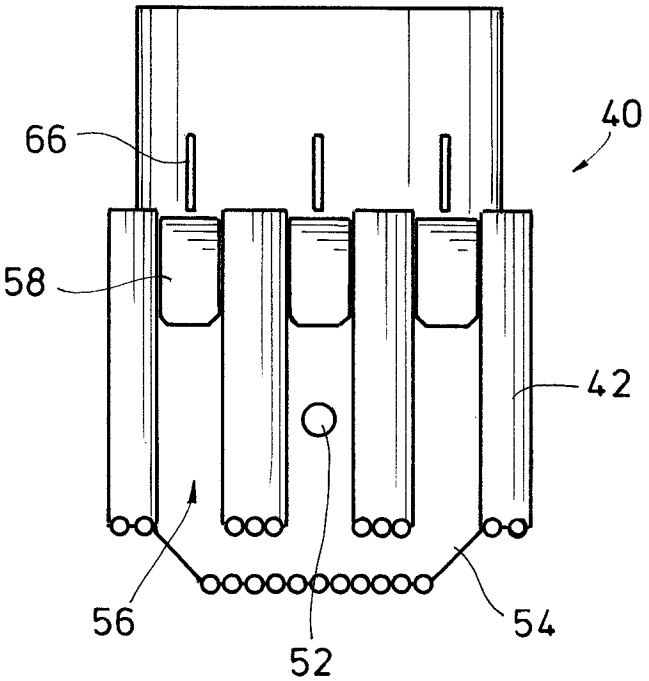
FIG. 4 is a side view of an example of the bit of FIG. 2 in a sealing configuration in accordance with the present invention.

Referring now to FIG. 4, an example of the bit 40 is shown wherein the sliding blades 58 have been moved downward into the channels 56 thereby further isolating the space surrounding the bit 40 from the area in the wellbore 22 (FIG. 3) above the bit 40. Slots 66 are shown in the body 54, in which an extension or attachment on sliding blades 58 may extend through, so that a position of sliding blades 58 can be manipulated from within bit 40. An advantage of the sliding blades 58 is that an additional means of sealing in the space 64 (FIG. 3) can be achieved. In the example of FIG. 3, the space 64 thus extends below the collar 60 and packer 62 and into the spaces between the bit body 54 and inner surface of the wellbore 22. As such, the channels 56 occupy some portion of the sealed space 64. Examples exist where the sealed space is formed by the packer 62 or by engaging the sliding blades 58 with the cutting blades 42. In one alternative, a secondary seal is formed by deploying the packer 62 at a location above the seal formed by the sliding blades 58 and cutting blades 42.

Figure 5:
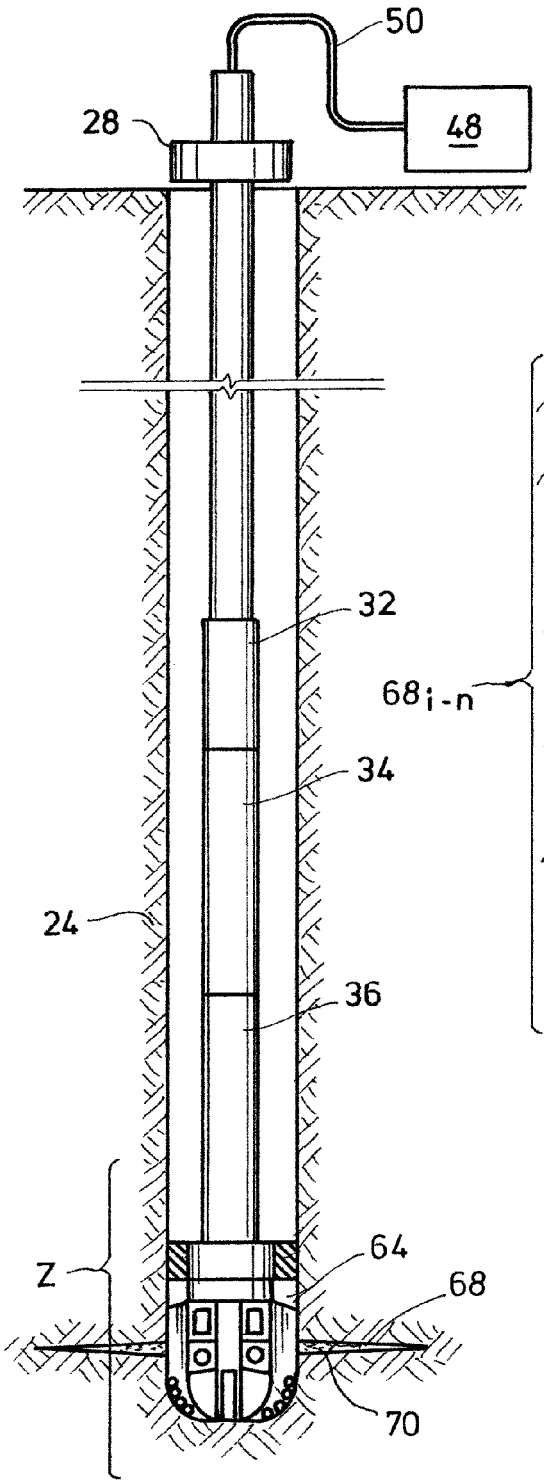
FIG. 5 is a side partial sectional, view of an example of the system of FIG. 3 completing a fracturing sequence in accordance with the present invention.

In the example of FIG. 5, a fracture 68 is shown extending into the formation 24 and in zone Z after having been initiated at the wellbore wall due to the pressurization of the sealed space 64. In the example of FIG. 5, fluid 70 is illustrated in the space 64 and making its way into the fracture 68. In one example operation, the fluid 70 can be drilling fluid but can also be a dedicated fracturing fluid. In an alternative embodiment, fluid 70 is held in a tank 72 separate from tank 48 and delivered to string 26 via line 74. In this example, fluid in tank 72 can be drilling or fracturing fluid. In one example the fluid 70 is solid-free acidic brine or other non-damaging type of fluid. In one example, from about 100 barrels to about 150 barrels of fluid are discharged from the fracturing nozzle 52 during the step of fracturing the formation 24. Yet further optionally, a proppant may be included within the fracturing fluid for maintaining the fractures 68 in an open position for enhancing permeability, as well as trapping sand that may otherwise flow into the wellbore 22 from the formation 24. While the fracture 68 is shown to be in a generally horizontal position, other embodiments exist wherein the fractures are oriented to extend along a plane of minimum horizontal principal stress so that multiple transverse fractures can be created that extend further into the rock formation away from the wellbore wall. Further, the swivel master 32 may be initiated during fracturing so that the portion of the drill string 26 above the swivel master 32 may continue to rotate without rotating the portion below the swivel master 32. Rotating the drill string 26 above the swivel master 32 can avoid the drill string 26 sticking to the wall of the wellbore 22.

Figure 6:
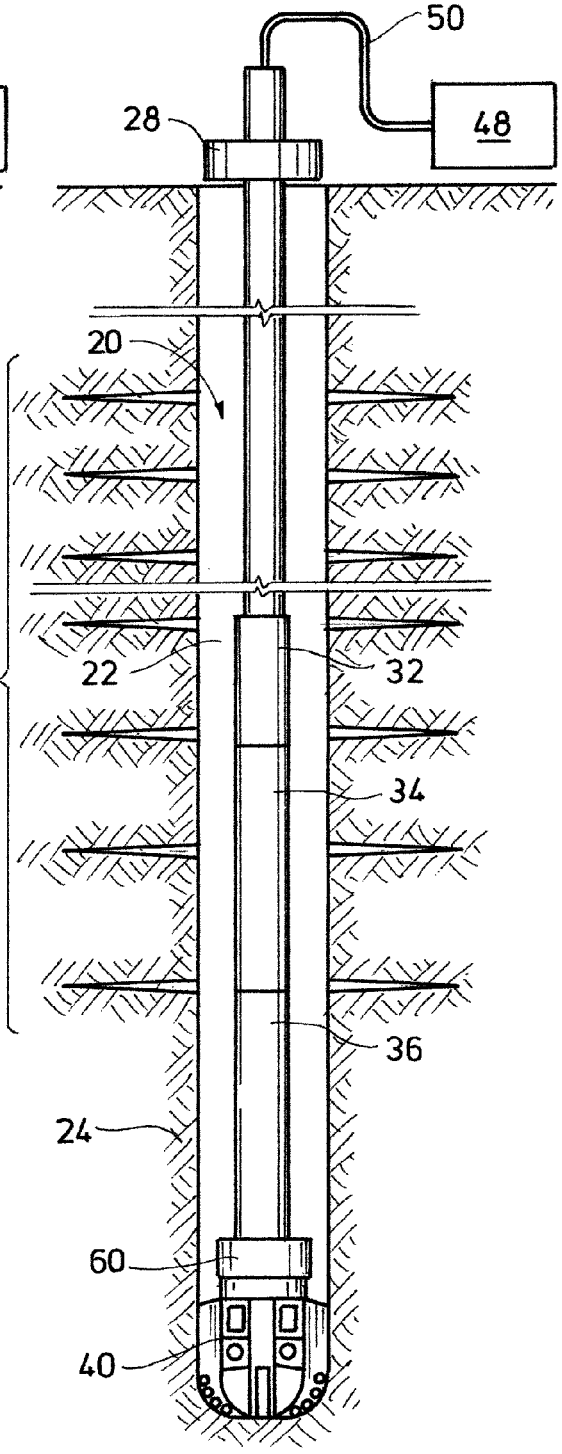
FIG. 6 is a side partial sectional view of an example of the system of FIG. 1 in a wellbore having fractures in multiple zones in accordance with the present invention.

Optionally, as illustrated in FIG. 6, the drilling system 20, which may also be referred to as a drilling and fracturing system, may continue drilling after forming a first fracture 68 and wherein the process of creating a fracture is repeated. As such, in the example of FIG. 6 a series of fractures $\mathbf{68}_{1-n}$ are shown formed at axially spaced apart locations within the wellbore 22. Further illustrated in the example of FIG. 6 is that the packer 62 (FIG. 5) has been retracted and stowed adjacent the collar 60 thereby allowing the bit 40 to freely rotate and further deepen the wellbore 22.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. For example, a locking mechanism can be included to lock the isolation device in place. Also, shear pins may optionally be included to allow unsetting of the isolation device when being pulled. These and other similar modifications will readily suggest themselves to those skilled in the art, and are intended to be encompassed within the spirit of the present invention disclosed herein and the scope of the appended claims.

What is claimed is:

1. A system for use in a subterranean wellbore comprising:

a drill bit on an end of a drill string and in selective fluid communication with pressurized fluid;

a seal that is selectively deployed from the drill bit into sealing engagement with an inner surface of the wellbore to define an enclosed space in a lower portion of the wellbore; and a fracturing port on the drill bit that is selectively opened and closed and that is in communication with the source of the pressurized fluid.

2. The system of claim 1, further comprising a drilling fluid exit nozzle on the drill bit that is selectively opened and closed, wherein the source of the pressurized fluid comprises a first source of pressurized fluid, wherein the drilling fluid exit nozzle is in communication with a second source of pressurized fluid, and wherein pressurized fluid from the second source of pressurized fluid comprises drilling fluid.

3. The system of claim 2, wherein when the drill string is being rotated for drilling a wellbore, the exit nozzle is open so that fluid flows from the exit nozzle into the wellbore, and when the fracturing port is open and the packer is deployed, pressurized fluid from the second source of pressurized fluid flows from the drill bit into the space to create a fracture in a portion of a formation circumscribing the wellbore.

4. The system of claim 1, further comprising a pressure intensifier having an inlet in communication with the source of pressurized fluid and an exit in communication with the bit, so that when the pressure intensifier is operating and receives fluid from the source of pressurized fluid, a pressure of the fluid is increased by the pressure intensifier.

5. The system of claim 1, wherein the seal comprises a packer mounted on a collar that is attached to a portion of the bit adjacent the drill string.

6. The system of claim 1, wherein the seal comprises elongated cutting blades on an outer surface of the bit and sliding blades that move into a channel defined between the cutting blades and sealingly engage with lateral sides of the cutting blades.

7. The system of claim 1, wherein the source of pressurized fluid is disposed outside of the wellbore.

8. A system for use in operations in a subterranean wellbore comprising:

a drill bit depending from a string of tubulars to define a drill string;

a seal that selectively expands radially outward from the drill string into sealing engagement with an inner surface of the wellbore;

a drilling nozzle on the bit in selective communication with a source of pressurized drilling fluid; and a fracturing port on the drill bit in selective communication with a source of pressurized fracturing fluid.

9. The system of claim 8, wherein the seal comprises a packer hat mounts onto the drill bit adjacent the string of tubulars.

10. The system of claim 8, wherein the fracturing port is disposed between the seal and the drilling nozzle.

11. The system of claim 8, wherein when the fracturing port is open the drilling nozzle is closed, and when the fracturing port is closed the drilling nozzle is open.

12. The system of claim 8, further comprising an intensifier in the drill string for receiving fluid from the source of pressurized fluid, further pressurizing the fluid, and directing the further pressurized fluid to the drill bit.

13. The system of claim 8, wherein the seal comprises a first seal, and wherein a second seal is defined by elongated cutting blades on an outer surface of the bit, and sliding blades that move into a channel defined between the cutting blades to sealingly engage with lateral sides of the cutting blades.

14. A system for forming and fracturing a subterranean wellbore comprising:

a drill bit depending from a length of drill pipe to define a drill string;

a seal that extends radially outward from the drill string into sealing engagement with an inner surface of the wellbore;

a drilling nozzle on the bit in selective communication with a source of pressurized drilling fluid that is in an open position when the drill bit is drilling the wellbore; and a fracturing port on the drill bit in selective communication with a source of pressurized fracturing fluid that is in a closed position when the drill bit is drilling the wellbore and is selectively opened when the drill bit is rotationally stationary, so that the pressurized fracturing fluid can flow from the inside the drill bit and into the wellbore and fracture the wellbore.

15. The system of claim 14, wherein the seal is on the drill bit to define a discrete sealed space in the wellbore adjacent the drill bit, that when subjected to the pressurized fracturing fluid can be fractured at a location within a discrete zone in the formation.

16. The system of claim 14, wherein when the fracturing port is open the drilling nozzle is closed, and when the fracturing port is closed the drilling nozzle is open.

17. The system of claim 14, further comprising an intensifier in the drill string for receiving fluid from the source of pressurized fluid, further pressurizing the fluid, and directing the further pressurized fluid to the drill bit.

18. The system of claim 14, wherein the seal comprises elongated cutting blades on an outer surface of the bit and sliding blades that move into a channel defined between the cutting blades and sealingly engage with lateral sides of the cutting blades.

* * * * *

UNITED STATES PATENT AND TRADEMARK OFFICE

CERTIFICATE OF CORRECTION

PATENT NO. : 8,893,778 B2
APPLICATION NO. : 13/714485
DATED : November 25, 2014
INVENTOR(S) : Zhou It is certified that error appears in the above-identified patent and that said Letters Patent is hereby corrected as shown below:

In the Claim

Column 6, Line 38, Claim 9 Delete “hat” and insert --that--.

Signed and Sealed this
Thirty-first Day of March, 2015

Michelle K. Lee

Michelle K. Lee
*Director of the United States Patent and Trademark Office*